United States Patent [19]

Widman

[11] Patent Number: 4,474,087

[45] Date of Patent: Oct. 2, 1984

[54] TOOL FOR MANIPULATING THE CLOSURES OF BEVERAGE CONTAINERS

[76] Inventor: Bruno Widman, 812 Oakton, Romeoville, Ill. 60441

[21] Appl. No.: 514,568

[22] Filed: Jul. 18, 1983

[51] Int. Cl.[3] ..... B67B 7/44

[52] U.S. Cl. ..... 81/3.1 R; 81/3.46 R; 81/3.4

[58] Field of Search ..... 81/3.46 R, 3.4, 3.34, 81/3.1 R; D8/40, 33

[56] References Cited

U.S. PATENT DOCUMENTS

| | | | |
|---|---|---|---|
| 1,752,189 | 3/1930 | Lotz | 81/3.4 |
| 2,291,866 | 8/1942 | Bethke | D8/40 X |
| 2,323,621 | 7/1943 | Penney | D8/40 X |

*Primary Examiner*—Roscoe V. Parker

*Attorney, Agent, or Firm*—Augustus G. Douvas

[57] ABSTRACT

A tool for manipulating beverage bottle closures in which a prior art recapper cup for applying press-fit bottle caps is modified to include an elongated slot to engage thereby a lift tab for opening a flap closure for a tab-top container. The recapper cup is further modified to include a set of four ribs so that screw-type bottle caps can also be operated on by the recapper cup.

2 Claims, 7 Drawing Figures

TOOL FOR MANIPULATING THE CLOSURES OF BEVERAGE CONTAINERS

BACKGROUND OF THE INVENTION

The invention relates to improvements in a particular class of prior art tool having a recapper cup for applying press-fit beverage bottle caps. In particular, these improvements relate to modifications by which screw-type bottle caps and also the lift tabs of tab-top cans are manipulated by that type of tool.

The prior art is prolific in designs having recapper cups for applying press-fit beverage bottle caps. Typical patents are U.S. Pat. No. Re. 23,731; U.S. Pat. Nos. 1,116,438; 1,422,970; 2,593,091; 2,641,397; 2,738,117; and 2,801,557. However, none of these tools has also used the recapper cup to operate lift tabs for tab-top cans and also to twist on and off screw-type bottle caps. U.S. Pat. No. 4,337,678 discloses a tool having a cup-like structure for operating a screw-type cap only.

SUMMARY OF THE INVENTION

Accordingly, a principal object of the invention is to expand the utility of recappers for press-fit bottle caps so that lift tabs for tab-top cans and also screw-type bottle caps can be manipulated by the recapper.

The foregoing object is attained in the present invention by modifying a cup-like recapper element to include an elongated, relatively thin slot which is formed adjacent a flared lip of the cup. The slot is sandwiched between two projecting ribs or lugs formed in the sloping cup sides which define the recapper. The two ribs not only provide for necessary reinforcement of the slot, but, together with two additional ribs which also project into the interior of the recapper cup, provide means for engaging the ribbed sides of a screw-type bottle cap.

Accordingly, the recapper not only serves its usual prior art function of recapping press-fit caps, but also lifts container tabs and removes and reapplies screw-type caps to bottles.

DESCRIPTION OF THE DRAWINGS

In order that all of the structural features for attaining the objects of this invention may be readily understood, reference is herein made to the accompanying drawings wherein.

DETAILED DESCRIPTION OF THE PREFERRED EMBODIMENT

Figure 1:
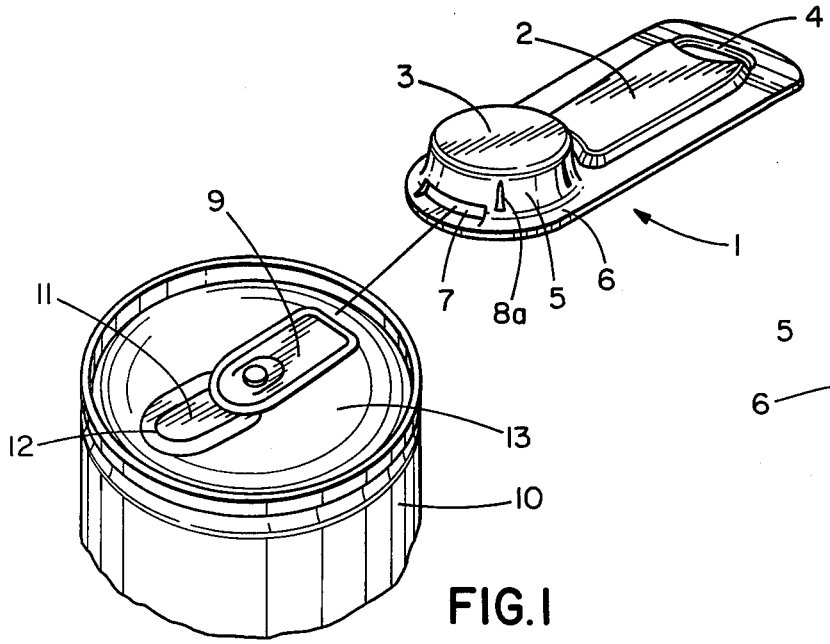
FIG. 1 is a perspective view showing the potential application of the tool of this invention to a tab-top can.

Referring to the drawings, tool 1 is formed from a metal body 2 to include a cup-like recapper element 3 and a conventional press-fit cap-lever element 4 (FIG. 1).

Figure 2:
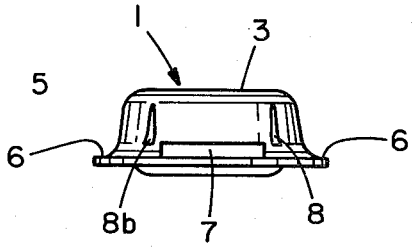
FIG. 2 is an end view showing the tab engaging slot formed in the recapper cup.

Recapper 3 has a sloping sidewall 5 which terminates in a flared lip 6 for most of the sidewall periphery (FIG. 2).

Recapper 3 can be used for its conventional function of recapping beverage bottles with press-fit caps (not shown). Recapper 3 is formed with an elongated slot 7 located in a peripheral portion of sidewall 5 immediately adjacent flared lip 6. Slot 7 is sandwiched between two inwardly projecting ribs or lugs 8*a* and 8*b* formed in sidewall 5. Ribs 8*a* and 8*b* not only provide for the necessary reinforcement of slot 7, but, together with two additional ribs 8*c* and 8*d* which also project into the interior of recapper cup 3, provide means for engaging the ribbed sides of a screw-type bottle cap (FIGS. 5–7) to attain an additional mode of operation described later.

Figure 3:
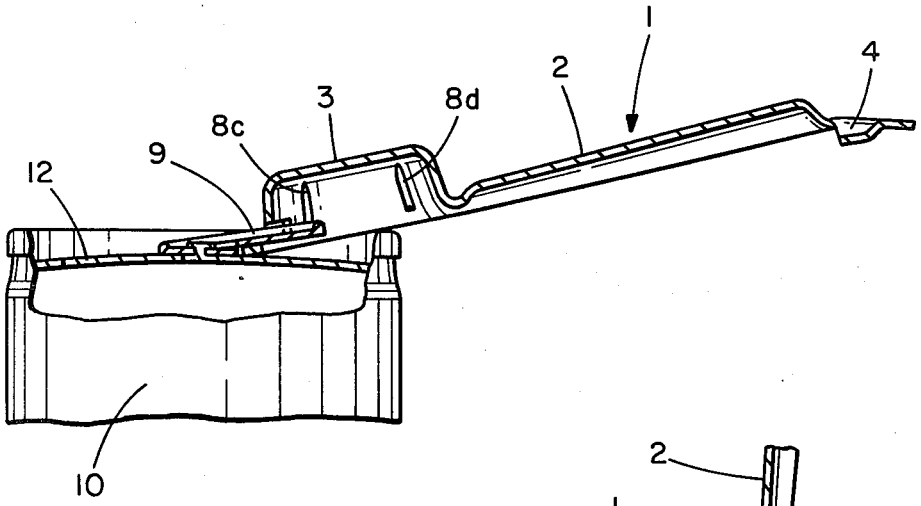
FIG. 3 is a view showing the tool in section and engaging the container tab.
Figure 4:
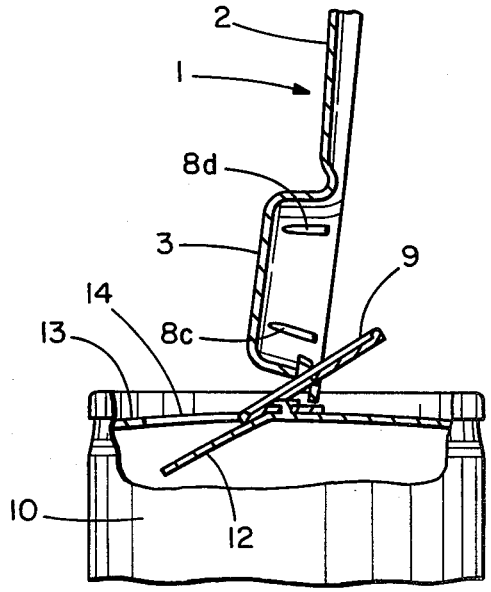
FIG. 4 is a view sequentially related to FIG. 3 in which the tool is being used as a lever to pry open the flap closure of the tab-top can.

Slot 7 is sized so that it relatively tightly engages lift tab 9 of metal beverage container 10 when tool 1 is manipulated so that lift tab 9 is inserted with the slot (FIGS. 3 and 4) at a relatively low body 2 angle with the horizontal. As body 2 is manually elevated (FIG. 4), the lever prying action of tool 1, also elevates lift tab 9 causing closure flap 11 to break at scored line 12 from the remaining portion of container lid 13. Accordingly, an opening 14 is provided in container 10 through which beverage can be poured. Tool 1 thus performs an additional function not contemplated by the prior art recappers.

Figure 5:
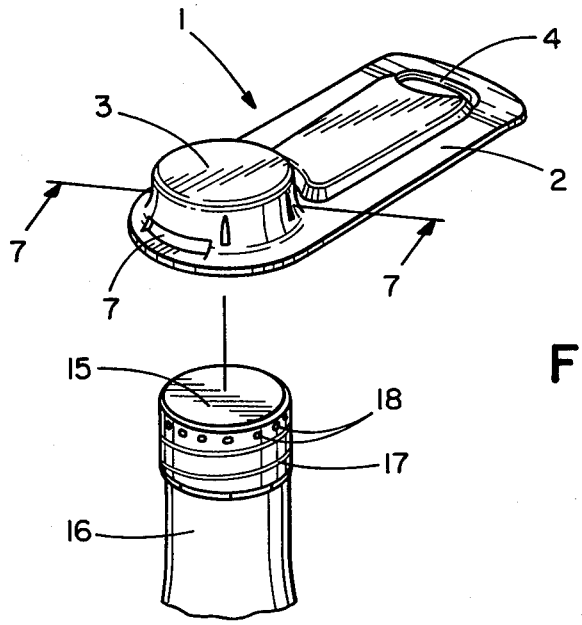
FIG. 5 is a perspective view showing the potential application of the tool to a beverage bottle having a screw-type container cap.
Figure 6:
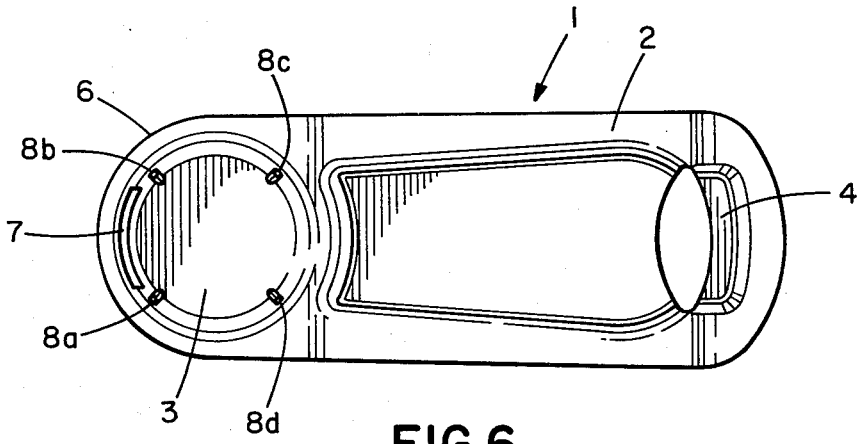
FIG. 6 is a plan view of the tool showing the disposition of the cap engaging lugs on the recapper cup.
Figure 7:
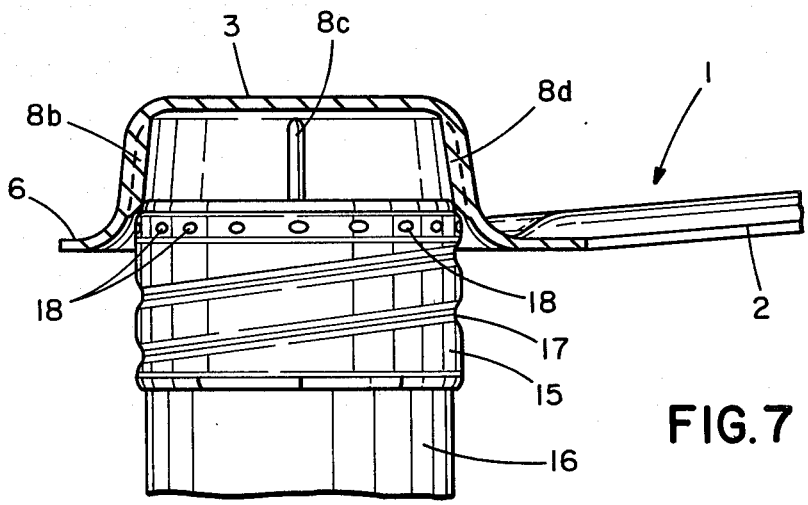
FIG. 7 is a view taken along line 7—7 of FIG. 5 and showing the engagement of the lugs to a screw-type bottle cap.

In FIG. 5, tool 1 is shown ready to be applied to a screw-type bottle cap 15 affixed to bottle neck 16. In its application, tool 1 is lowered upon cap 15 so that ribs 8*a*, 8*b*, 8*c*, and 8*d* tightly engage any ribs or projections 18 formed on the exterior of cap 15 (FIG. 7). With a tight frictional engagement established between the ribs and cap 15, body 2 acting as a handle is rotated clockwise or counterclockwise as required to either twist on or twist off cap 15 by engaging or disengaging threads 17 of cap 15 with respect to the mating bottle thread.

Accordingly, recapper 3 performs still another function not contemplated by the prior art recappers.

It should be understood that the above described embodiments are merely illustrations of the principles of this invention. Modifications can be made without departing from the scope of the invention.

What is claimed is:

1. In a tool for manipulating beverage bottle closures including crown caps, screw-type caps and the lift tabs of tab-top beverage containers in which the tool has a handle integrally joined to a crown-cap recapper cup defined by a substantially flat and circular cup bottom from which a circular cup sidewall projects to terminate in a narrow flared lip which is generally parallel to but spaced from the bottom of the recapper cup by the depth of the recapper cup sidewall and with the recapper cup being sized to apply a press-fit crown cap to a beverage container, the improvement comprising an elongated slot formed in the recapper cup sidewall immediately adjacent and aligned lengthwise with a portion of the flared lip remote from the handle and having a slot width extending between the flared lip and the bottom of the cup which tightly receives an insert lift tab of a tab-top container when the flared lip is wedged between the lift tab and the container top to pry open the lift tab by using the projecting edge of the flared lip as a fulcrum supported on the surface of a tab-top beverage container to thus pivot the slot and the portion of the lift tab inserted therein, a pair of substantially parallel ribs formed in the cup sidewall immediately adjacent the elongated slot by which the seating engagement of the recapper cup upon a screw-type cap for a beverage container enables the screw-type cap to be twisted on and off its associated bottle, and one or more additional ribs formed on the sidewall of the recapper cup to enhance the frictional engagement of the screw-type cap.

2. The tool of claim 1 in which the narrow flared lip is formed on and extends for the entire periphery of the tool generally in a common plane.

* * * * *